US012605005B1

(12) United States Patent
Kiernan

(10) Patent No.: US 12,605,005 B1
(45) Date of Patent: Apr. 21, 2026

(54) DETACHABLE CARPET

(71) Applicant: GAIA RUGS INC, Yorba Linda, CA (US)

(72) Inventor: Keith Kiernan, San Dimas, CA (US)

( * ) Notice: Subject to any disclaimer, the term of this patent is extended or adjusted under 35 U.S.C. 154(b) by 0 days.

(21) Appl. No.: 19/092,646

(22) Filed: Mar. 27, 2025

(51) Int. Cl.
*A47G 27/02* (2006.01)

(52) U.S. Cl.
CPC ..... *A47G 27/025* (2013.01)

(58) Field of Classification Search
CPC . A47G 27/0293; B44C 1/26–28; A47L 23/26; A47L 23/266
See application file for complete search history.

(56) References Cited

U.S. PATENT DOCUMENTS 3,663,980 A * 5/1972 Conklin ..... A47L 23/266 15/215
6,645,597 B1 * 11/2003 Swain ..... B60N 3/048 428/68
2001/0017017 A1 * 8/2001 Pacione ..... A47G 27/0487 52/578
2009/0274868 A1 * 11/2009 Hellman ..... A47G 27/0206 428/123
2012/0011795 A1 * 1/2012 Pacione ..... A47G 27/0475 156/289
2017/0105563 A1 * 4/2017 Dawson ..... D06N 7/0071
2017/0136730 A1 * 5/2017 Dawson ..... B32B 5/024
2018/0118073 A1 5/2018 Green
2020/0024799 A1 * 1/2020 Bing ..... B32B 3/30
2020/0337489 A1 * 10/2020 Dawson ..... E04F 15/186
2022/0117426 A1 * 4/2022 Soleimani ..... B32B 5/18

* cited by examiner

*Primary Examiner* — Larissa Rowe Emrich
(74) *Attorney, Agent, or Firm* — Nicholas E. Najera

(57) ABSTRACT

A detachable carpet disclosed comprises a carpet cover, multiple edge strips, and a mat, wherein the carpet cover is constructed as a surface with decorative and functional properties, the edge strips are connected to the side of the carpet cover facing a mat, wherein the edge strips and the carpet cover are separate structures; the mat is constructed as a support layer, which is detachably connected to the edge strips, thereby detachably connecting to the carpet cover via the edge strips.

15 Claims, 13 Drawing Sheets

DETACHABLE CARPET

TECHNICAL FIELD

This invention relates to carpets, and more specifically to a detachable carpet.

BACKGROUND

Traditional carpets are typically designed with a fixed structure, making them difficult to detach and clean, which results in inconvenience for maintenance and cleaning. Some detachable carpet designs have problems such as unstable connections, susceptibility to misalignment, and cumbersome operations. Therefore, there is a need for a carpet design that is convenient for cleaning and has a stable connection.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended to limit the scope of the claimed subject matter.

A detachable carpet is provided, comprising: a carpet cover, constructed as a surface; multiple edge strips, connected to a mat-side of the carpet cover, wherein the multiple edge strips and the carpet cover are separate structures; and a mat constructed as a support layer and detachably connected to the edge strips, detachably connecting to the carpet cover via the multiple edge strips.

The above aspects or examples and advantages, as well as other aspects or examples and advantages, will become apparent from the ensuing description and accompanying drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

Figure 1:
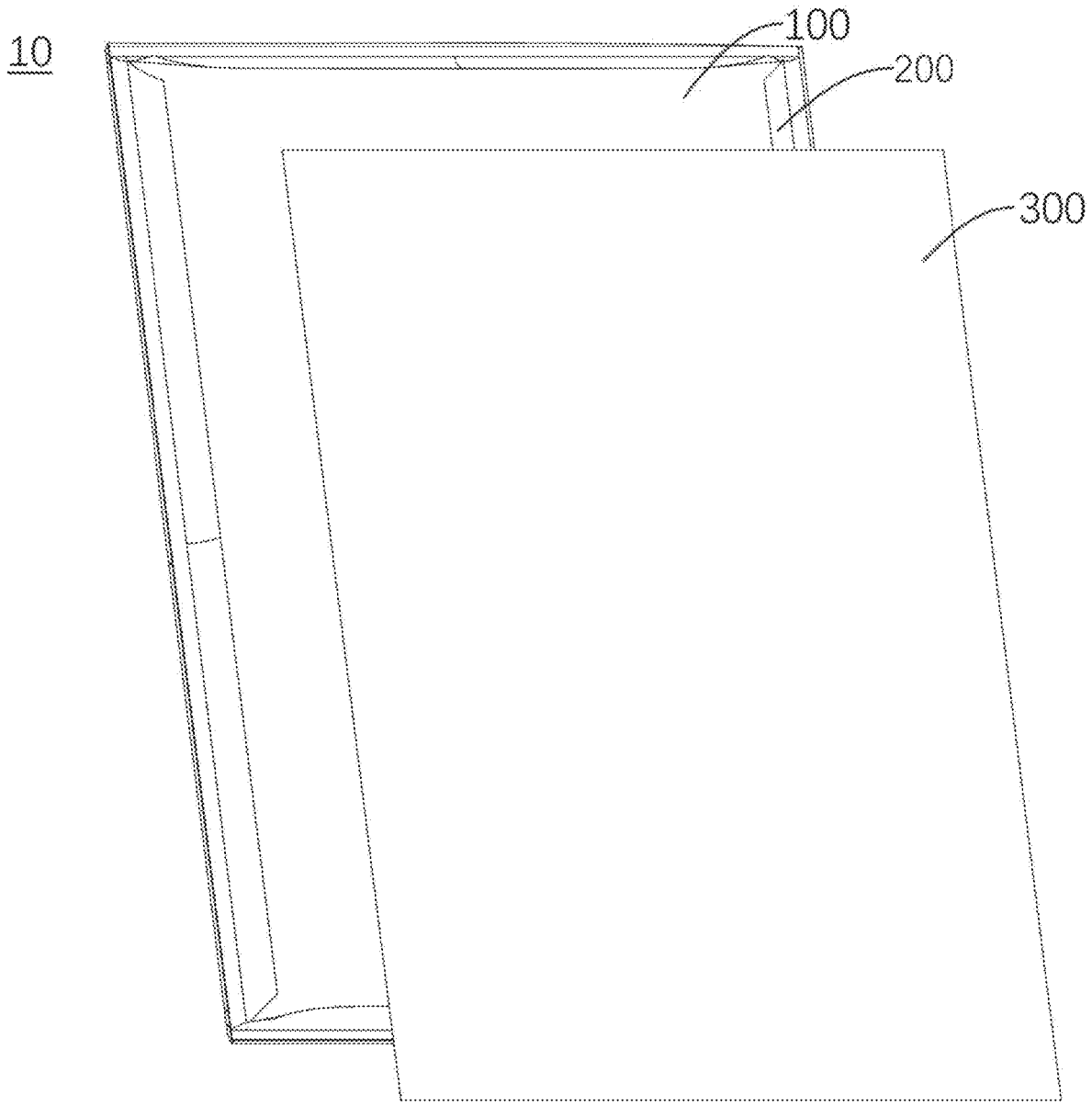
FIG. 1 is a schematic structural view of a detachable carpet in an embodiment of the present invention.

Reference Numbers: detachable carpet —10; carpet cover —100; base cloth —101; stitch-locking structure —102; stitch thread —1021; gluing structure —103; Velcro structure —104; hook surface —1041; loop surface —1042; button structure —105; button —1051; buttonhole —1052; magnet structure —106; first magnet portion —1061; second magnet portion —1062; zipper structure —107; zipper teeth —1071; zipper head —1072; wrapping strip —108; edge strip —200; carpet sticker —201; mat —300; pre-fixed structure —301; and slot structure —3011.

DETAILED DESCRIPTION OF THE INVENTION

The present disclosure will be further described in detail below with reference to the drawings. A preferred embodiment is described in the drawings. However, the present disclosure can be implemented in many different forms and is not limited to the embodiments described herein. Rather, these embodiments are provided to provide a thorough understanding of the present disclosure. The specific embodiments are only explanations of the present disclosure, and the embodiments are not intended to limit the present disclosure. Rather, various modifications may be made in the details within the scope and range of equivalents of the claims and without departing from the present disclosure.

The present disclosure will be described in more details below with reference to the accompanying drawings and in conjunction with embodiments. The examples are provided for better illustration of the present disclosure and should not limit the scope of the present disclosure. In practice, technicians skilled in the art might make small modifications and/or variations of the present disclosure without departing from the scope or spirit of the present disclosure. For example, features described in part of one embodiment may be used in another to create a new embodiment. It is therefore desirable that the present disclosure encompass such modifications and/or variations falling within the scope of the appended claims and their equivalents.

In the description of the present disclosure, terms like "longitudinal", "transverse", "up", "down", "front", "back", "left", "right", "vertical", "horizontal", "top", "bottom" denote orientation or positional relationships based on those shown in the drawings and are intended for ease of description only, which in no way entails that the present disclosure must be constructed and operated in a particular orientation and therefore cannot be construed as limiting to the present disclosure. Terms like "joint", "attach" and "set" used in the present disclosure should be understood in a broad sense, for example, may indicate a direct connection or indirect connection through intermediate components; and it may be a wired electrical connection, a radio connection, or a wireless communication signal connection. The exact meanings of the above terms may slightly differ and should be derived from the actual situation by technicians skilled in the art accordingly.

As shown in FIG. 1, the present application provides a detachable carpet 10, comprising a carpet cover 100, an edge strip 200, and a mat 300.

A. Carpet Cover 100

The carpet cover 100 can be designed in various patterns, colors, and textures to cater to the aesthetic preferences of different users. For instance, it can feature geometric designs, artistic prints, or natural textures (such as wood grain or stone patterns) to complement modern, vintage, or nature-inspired home décors. The material of the carpet cover 100 can be tailored to specific functional needs. For example, thick polyester or wool can be used for soundproofing, effectively reducing noise and making it ideal for living rooms or bedrooms. Materials like PVC or diatomaceous earth can be used for water resistance, making it suitable for damp areas such as bathrooms or kitchens. In some versions, the carpet cover 100 can also be made from wool, synthetic fibers, cotton, blends, silk, bamboo fibers, or diatomaceous earth. In addition, it can be manufactured using machine weaving, hand weaving, tufting, needle punching, or printing. The surface texture of the carpet cover 100 may include options like long pile, short pile, loop pile, cut pile, or flat weave. In practical use, customers can select the type of carpet cover 100 based on their specific usage scenarios, functional requirements, and aesthetic tastes.

In this embodiment, as shown in FIG. 1, the carpet cover 100 and the mat 300 are connected detachably. This connection is suitable for simple home or office environments with low decorative demands, featuring a simple structure, easy cleaning and replacement, and low cost.

In this embodiment, as shown in FIG. 1, the detachable connection is achieved through the edge strip 200. The carpet cover 100 is detachably connected to the mat 300 via the friction between the edge strip 200 and the mat 300. This design not only enhances flexibility in use but also facilitates quick assembly and disassembly based on user needs, improving the product's practicality and user experience. The stable connection of the edge strip 200 ensures a tight fit between the carpet cover 100 and the mat 300 while maintaining ease of disassembly, making it suitable for various usage scenarios.

Figure 2:
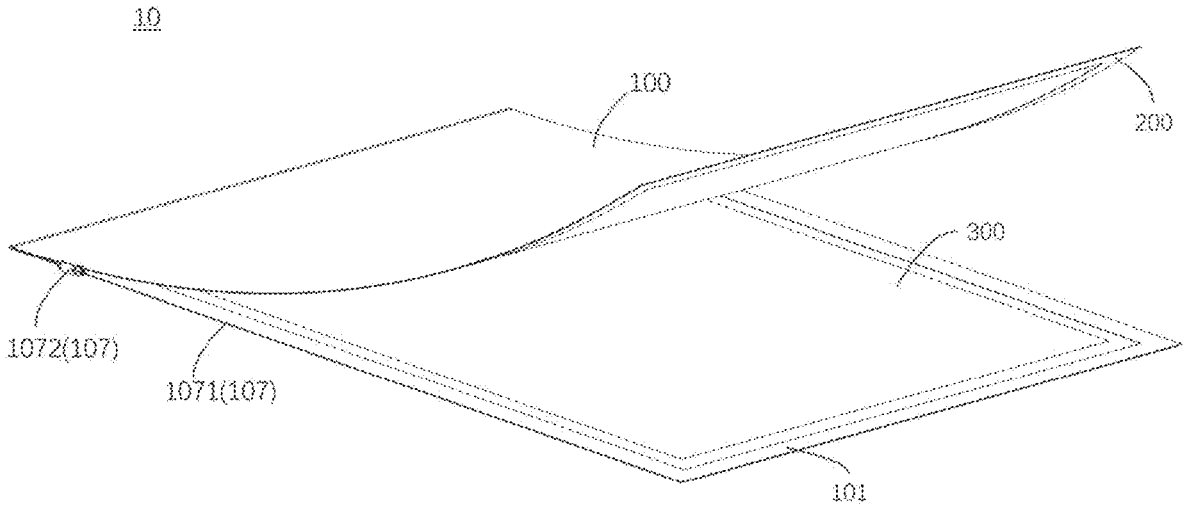
FIG. 2 is a schematic structural view of a detachable carpet in Embodiment 1 of the present invention.

In Embodiment 1, the carpet cover 100 and the base cloth 101 jointly enclose the mat 300. For example, as shown in FIG. 2, in Embodiment 1, the carpet cover 100 and the base cloth 101 are designed with one side stitched and three sides open. The one-side stitching ensures that the carpet cover 100 does not easily shift, enhancing comfort. The three-sided open design facilitates disassembly and cleaning. As shown in FIG. 2, the carpet cover 100 and the base cloth 101 form an inner cavity with three open sides, which is closed by a zipper structure 107. The zipper structure 107 includes zipper teeth 1071 and a zipper head 1072. The zipper head 1072 closes the zipper teeth 1071 on the carpet cover 100 and the zipper teeth 1071 on the base cloth 101 to provide a more secure close, preventing the mat 300 from slipping out.

In some embodiments, the side of the base cloth 101 facing the ground (also referred to as the backside of the base cloth) is constructed as a surface with anti-slip properties to improve slip resistance.

In some embodiments, the surface of the carpet cover 100 facing mat 300 and the surface of the base cloth 101 facing mat 300 are constructed as damping fabrics with a certain degree of softness to prevent the mat 300 from sliding randomly.

In some embodiments, the three open sides between the carpet cover 100 and the base cloth 101 are closed by a bidirectional zipper to seal the inner cavity. Two zipper heads are located at both ends of the three open sides, moving toward the center until the inner cavity is closed.

In some embodiments, the three open sides of the carpet cover 100 have multiple zippers.

In some embodiments, Velcro or magnet structures are installed between three open edges of the carpet cover 100 and three open edges of the base cloth 101 facing the carpet cover 100, which allows the backside of the carpet cover 100 to be connected to the surface of the base cloth 101 facing the carpet cover 100 via Velcro or magnets, providing both convenience and firmness.

In some embodiments, the edge strip 200 covers the junction between the three open edges of the carpet cover 100 and the three open edges of the base cloth 101 facing the carpet cover 100 to enhance overall aesthetics.

B. Edge Strip 200

In this embodiment, the edge strip 200 is connected to the side of the carpet cover 100 facing mat 300. The edge strip 200 and the carpet cover 100 are separate structures. The edge strip 200 not only has decorative properties but also effectively wraps the mat 300, enhancing overall aesthetics while preventing the edges of the carpet cover 100 from curling up, improving the stability and durability of the carpet 10.

Figure 3:
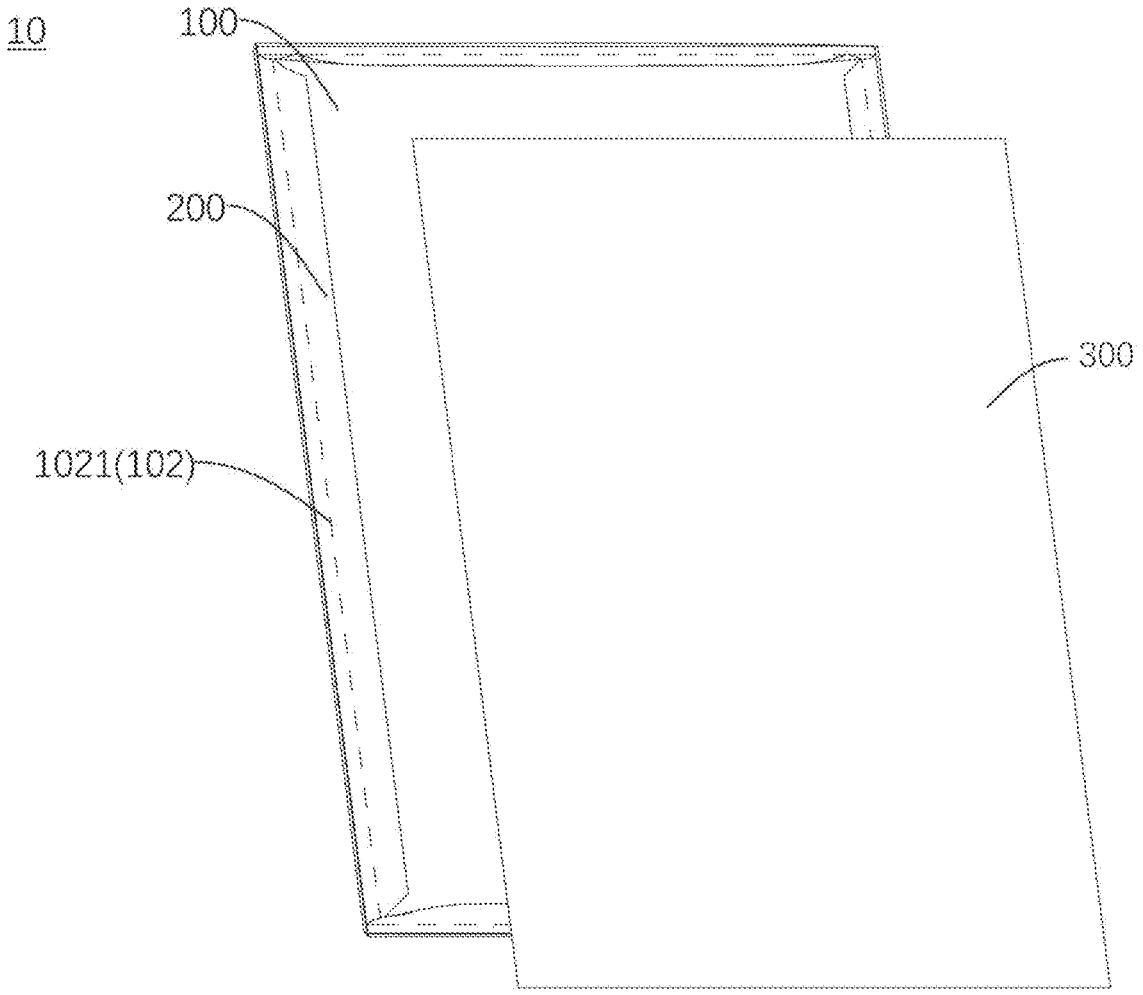
FIG. 3 is an exploded structural view of the detachable carpet in an embodiment of the present invention.

In this embodiment, the edge strip 200 and the carpet cover 100 are connected via a fixed connection. For example, as shown in FIG. 3, the fixed connection is achieved through a stitch-locking structure 102, which includes stitch threads 1021. The stitch threads 1021 pass through the edges of the edge strip 200 and the carpet cover 100, locking them together to prevent movement and wrinkling between the carpet cover 100 and the mat 300.

Figure 4:
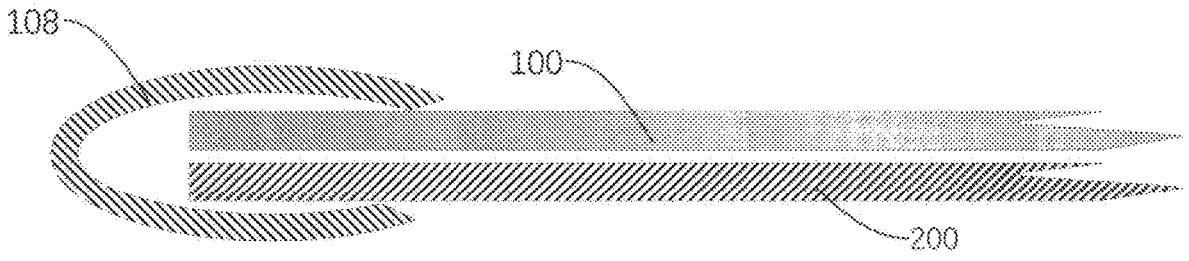
FIG. 4 is a partial cross-sectional structural view of an edge-wrapping structure in Embodiment 2 of the present invention.

In Embodiment 2, as shown in FIG. 4, the fixed connection is achieved by wrapping strip 108 to form a firm, flat edge. This connection method not only enhances the overall structural stability but also effectively prevents wear or curling of the carpet cover 100 edges, improving the aesthetics and durability of the detachable carpet 10.

Figure 5:
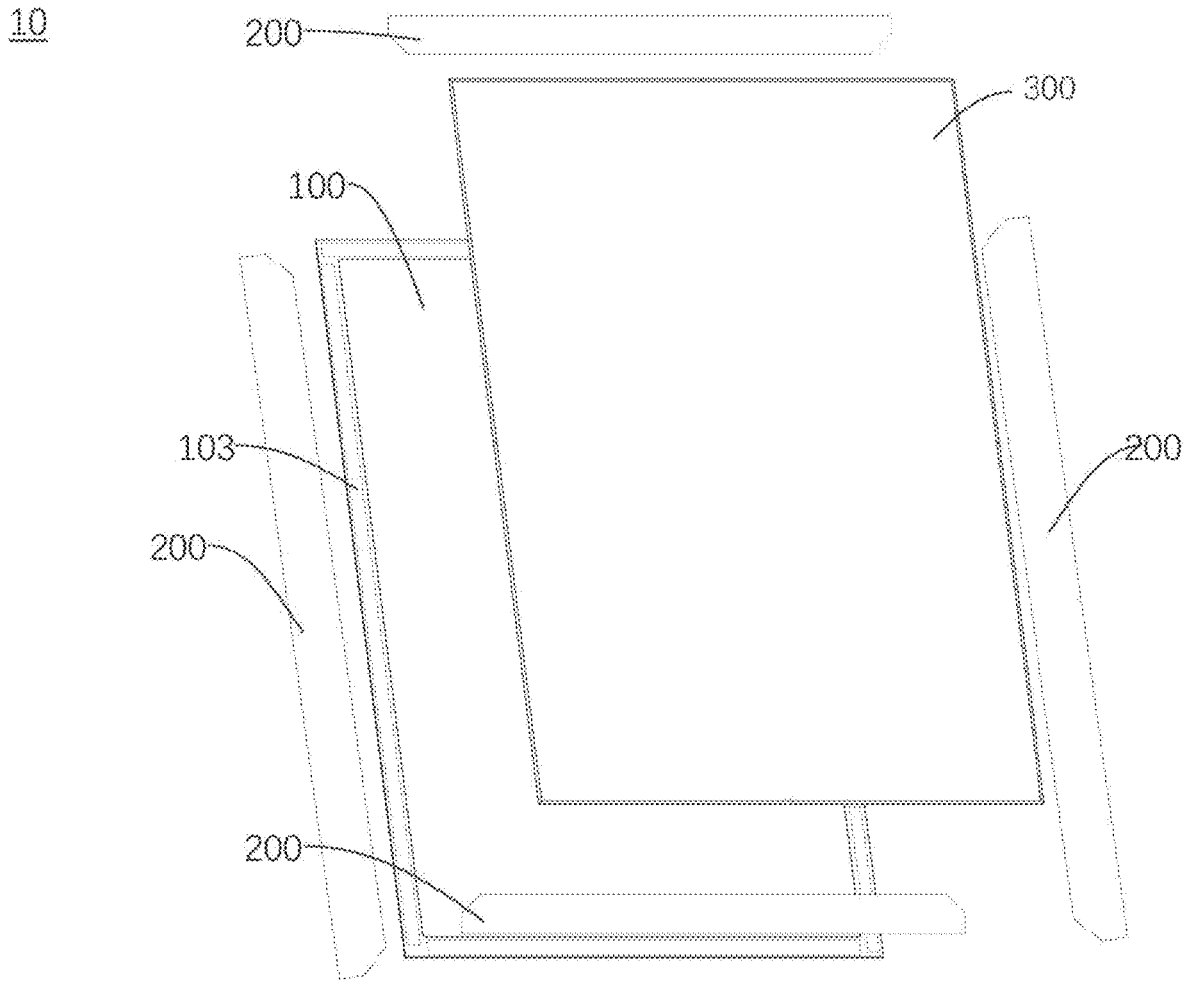
FIG. 5 is an exploded structural view of a detachable carpet in Embodiment 3 of the present invention.

In Embodiment 3, as shown in FIG. 5, the fixed connection is achieved through a gluing structure 103. The gluing structure 103 is a hot melt adhesive or double-sided tape applied to the contact surface between the edge strip 200 and the carpet cover 100, which are bonded together.

In Embodiments 4-6, the edge strip 200 and the carpet cover 100 are connected via the detachable connection.

Figure 6:
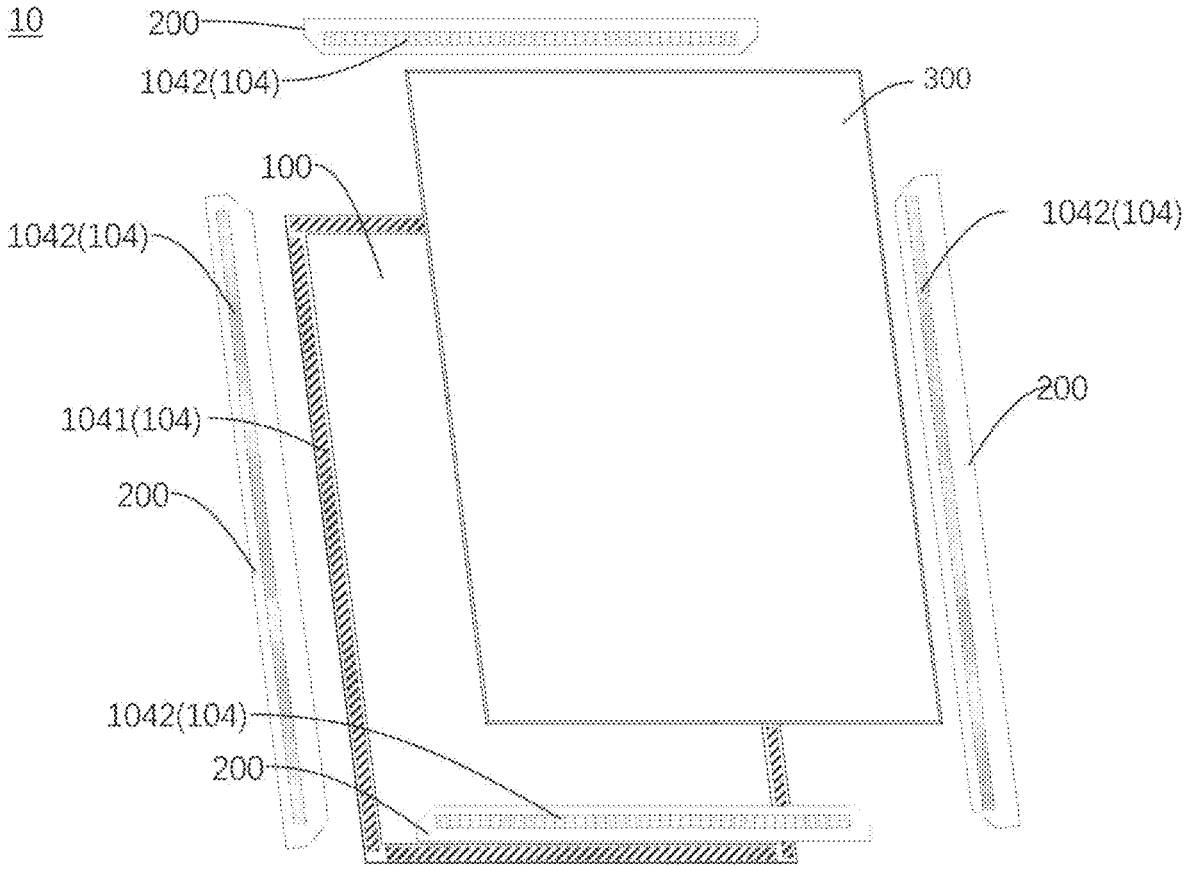
FIG. 6 is an exploded structural view of a detachable carpet in Embodiment 4 of the present invention.

In Embodiment 4, as shown in FIG. 6, the detachable connection is achieved through a Velcro structure 104. The Velcro structure 104 includes a hook surface 1041 and a loop surface 1042. The hook surface 1041 is fixed to the side of the carpet cover 100 facing the edge strip 200, and the loop surface 1042 is fixed to the corresponding side of the edge strip 200 facing the carpet cover 100. Pressing the hook surface 1041 and the loop surface 1042 together achieves a detachable connection, facilitating cleaning and replacement, preventing the carpet from shifting, and making it suitable for scenarios requiring frequent assembly and disassembly, allowing for long-term repeated use.

Figure 7:
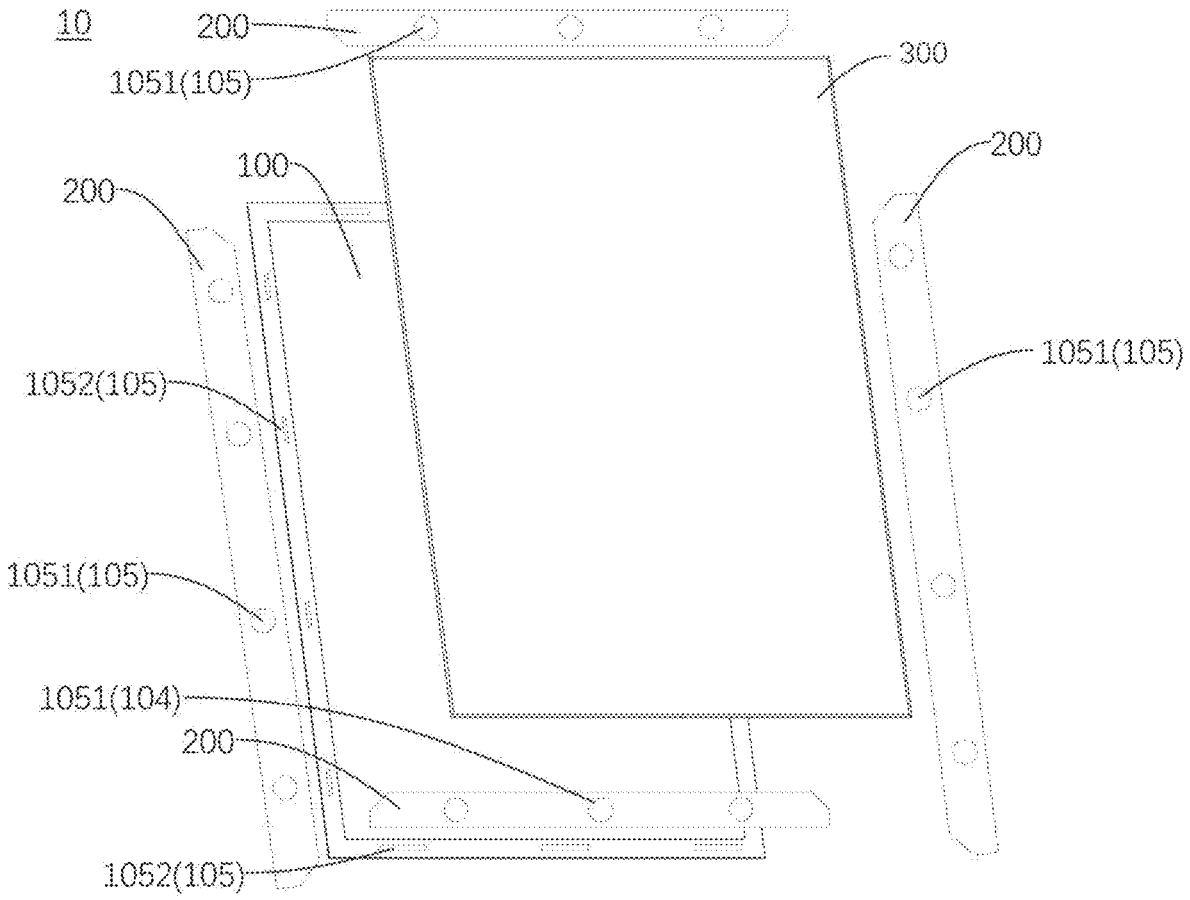
FIG. 7 is an exploded structural view of a detachable carpet in Embodiment 5 of the present invention.

In Embodiment 5, as shown in FIG. 7, the detachable connection is achieved through a button structure 105. The button structure 105 includes a button 1051 and a buttonhole 1052. The button 1051 is fixed to the side of the edge strip 200 facing the carpet cover 100, and the buttonhole 1052 is fixed to the corresponding side of the carpet cover 100 facing the edge strip 200. Engaging the button 1051 and the buttonhole 1052 achieves a detachable connection. This method is simple to operate, highly durable, and suitable for frequent use. It also provides a hidden design that maintains overall neatness.

Figure 8:
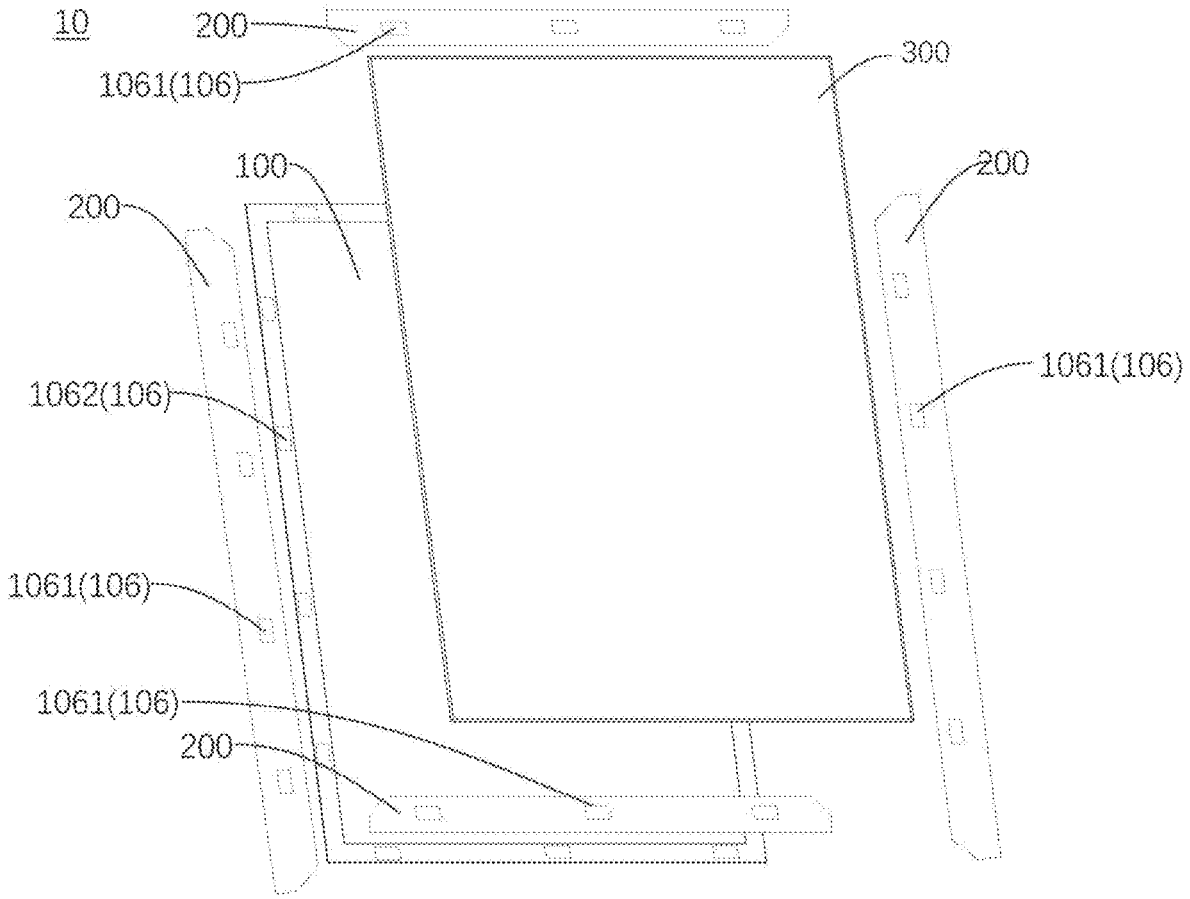
FIG. 8 is an exploded structural view of a detachable carpet in Embodiment 6 of the present invention.

In Embodiment 6, as shown in FIG. 8, the detachable connection is achieved through a magnet structure 106. The magnet structure 106 includes a first magnet portion 1061 and a second magnet portion 1062. The first magnet portion 1061 is fixed to the side of the edge strip 200 facing the carpet cover 100, and the second magnet portion 1062 is fixed to the corresponding side of the carpet cover 100 facing the edge strip 200. The magnetic force between the first magnet portion 1061 and the second magnet portion 1062 achieves a detachable connection. This method is simple, efficient, suitable for frequent use, and operates without noise interference.

In some embodiments, the detachable connection is achieved through a zipper structure. The zipper structure includes zipper teeth and a zipper head. The zipper teeth are fixed to the side of the edge strip 200 facing the carpet cover 100 and the side of the carpet cover 100 facing the edge strip 200. Sliding the zipper head engages the zipper teeth, achieving a detachable connection. This method is simple and quick, suitable for long-term repeated use.

In some embodiments, the edge strip 200 and the mat 300 are connected via a detachable connection.

In some embodiments, the detachable connection between the edge strip 200 and the mat 300 is achieved through a friction structure. In this embodiment, the friction structure comprises a surface with high roughness or a textured pattern formed by surface treatment. The friction structure connection provides a stable fit using high roughness or textured surfaces, preventing slipping and improving the durability and convenience of assembly and disassembly.

In some embodiments, the surface treatment methods include at least one of the flame treatments, silicone molding, or hot-press lamination.

In some embodiments, to provide flexible options and adapt to different usage, the number of edge strips 200 is two, three, or four, respectively, connected to two, three, or four sides of the carpet cover 100.

Figure 9:
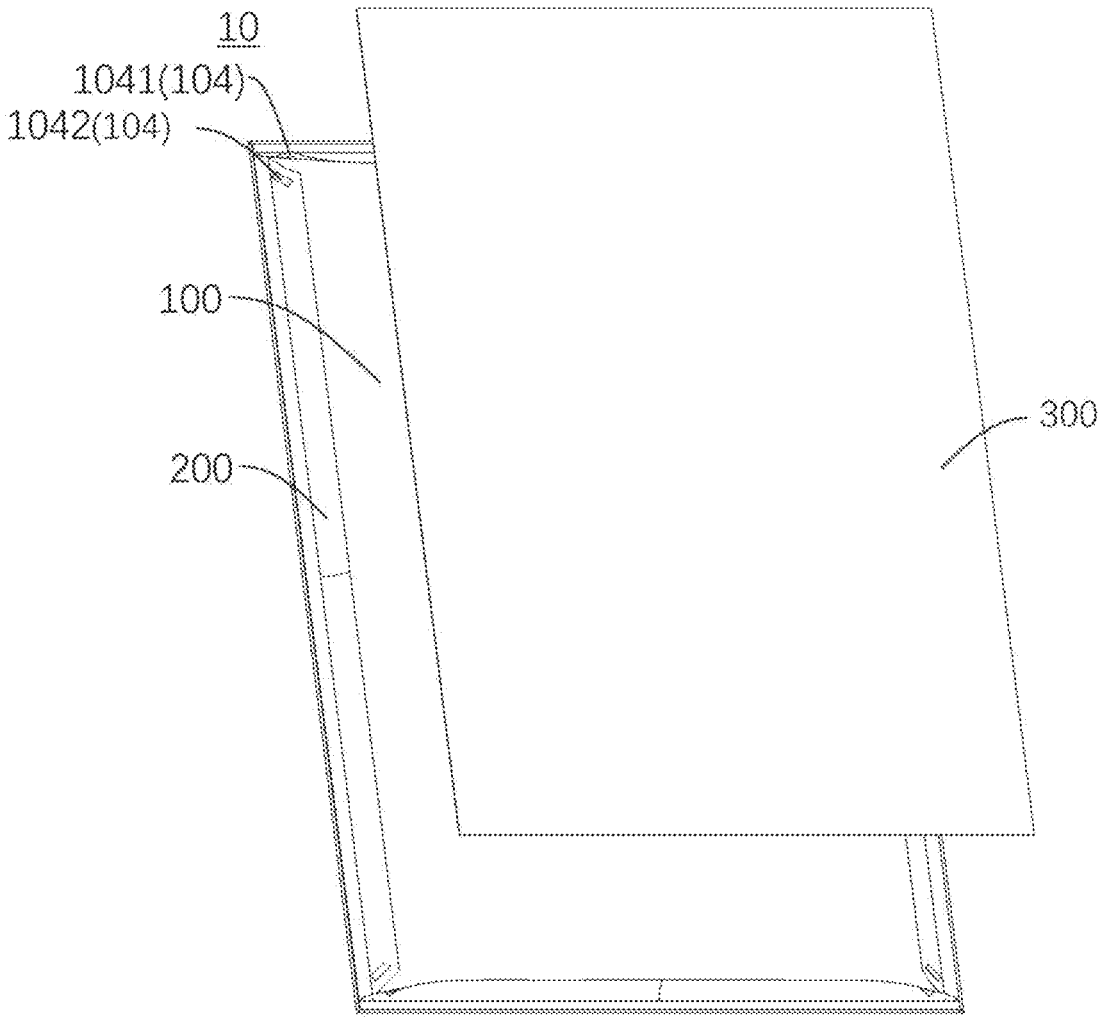
FIG. 9 is an exploded structural view of a detachable carpet in Embodiment 7 of the present invention.

In Embodiment 7, the edge strips 200 are connected to each other through a fixed structure to prevent further shifting or detachment. For example, as shown in FIG. 9, the fixed structure is a Velcro structure 104. The hook surface 1041 and the loop surface 1042 of the Velcro structure 104 are installed on two overlapping portions of one edge strip 200 and another edge strip 200, respectively. Pressing them together achieves a connection, making them simple to operate, easy to disassemble and replace, and suitable for occasions requiring frequent adjustments.

Figure 10:
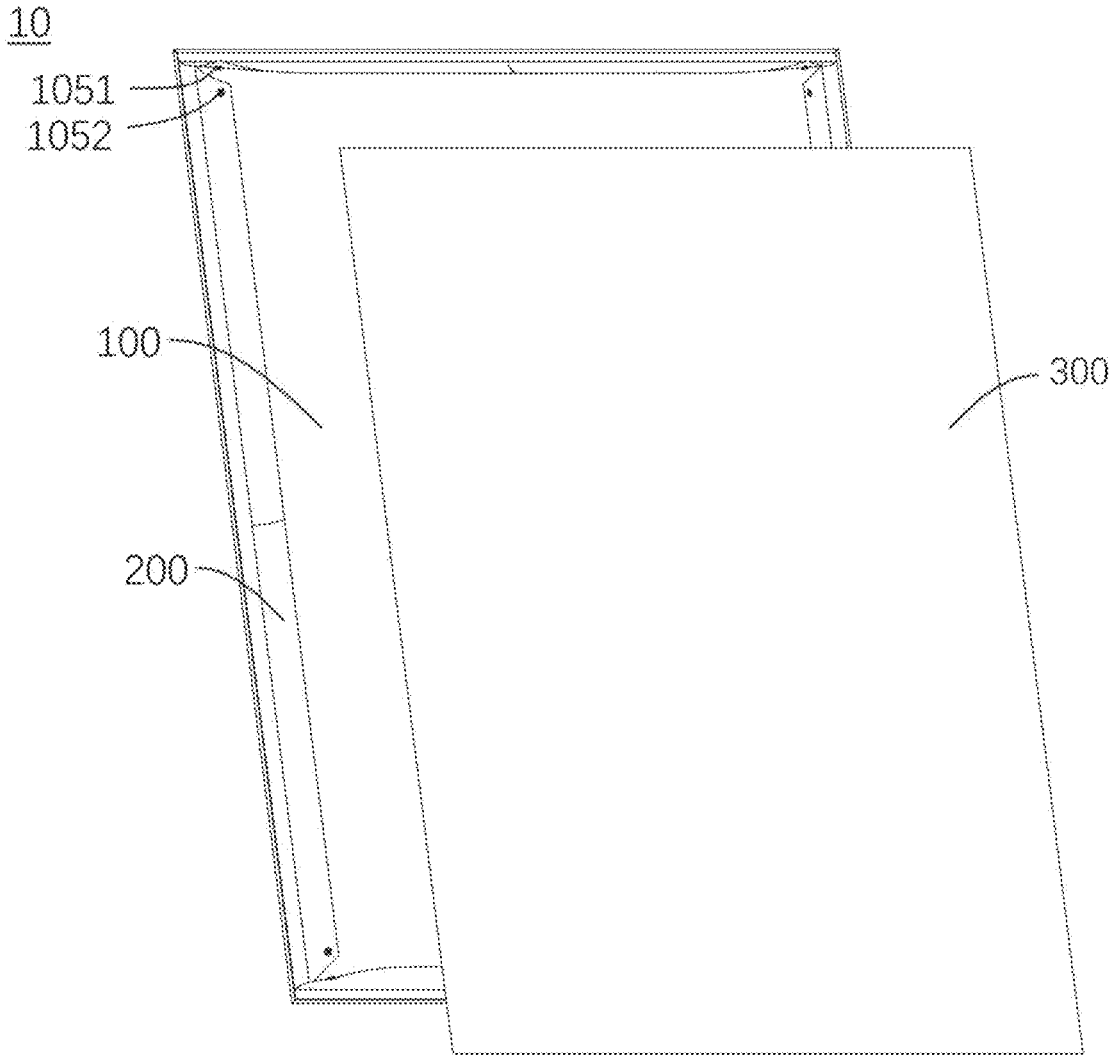
FIG. 10 is an exploded structural view of a detachable carpet in Embodiment 8 of the present invention.

In Embodiment 8, as shown in FIG. 10, the fixed structure is a button structure 105. The button 1051 and the buttonhole 1052 are set on two overlapping portions of one edge strip 200 and another edge strip 200, respectively. Engaging them achieves a connection, providing strong stability and ease of disassembly, making it suitable for detachable carpets 10 requiring frequent adjustments.

In some embodiments, the fixed structure is a gluing structure. The gluing structure is applied to two overlapping portions of one edge strip 200 and another edge strip 200, respectively. The gluing structure can be hot melt adhesive or double-sided tape, but not limited to these.

In some embodiments, the fixed structure is a back adhesive. The back adhesive is applied to two overlapping portions of one edge strip 200 and another edge strip 200, respectively. After removing the protective film, it can be directly pressed and adhered, making it quick and simple to operate, suitable for temporary use, or lightweight detachable carpets 10.

In some embodiments, the fixed structure is a nail structure. The nail connection structure is a U-shaped nail or carpet nail. U-shaped nail connection refers to using a nail gun to fix the edge strip 200 to the edge of the detachable carpet 10, suitable for thick detachable carpets 10. Carpet nail connection refers to manual nailing carpet nails to fix the edge strip 200, which is suitable for small areas or finely processed regions.

In some embodiments, the fixed structure is a clamping structure. The clamping structure is set on two overlapping portions of one edge strip 200 and another edge strip 200, respectively. The clamping structure can be a metal clip or a plastic clip. Metal clip connection refers to using metal clips to fix the edge strip 200, which is suitable for frequent disassembly. Plastic clip connection refers to using lightweight plastic clips to fix the edge strip 200, making it easy to operate and suitable for temporary use or lightweight detachable carpets 10.

In some embodiments, the fixed structure is a hot-press structure. The two overlapping portions of one edge strip 200 and another edge strip 200 can be bonded together through high temperature and pressure, which is suitable for mass production and provides strong adhesion.

In some embodiments, the fixed structure is a zipper structure. Zipper teeth and a zipper head are set on two overlapping portions of one edge strip 200 and another edge strip 200, respectively. The zipper head achieves the connection, facilitating frequent disassembly and replacement, making it suitable for occasions requiring flexible adjustments.

Figure 11:
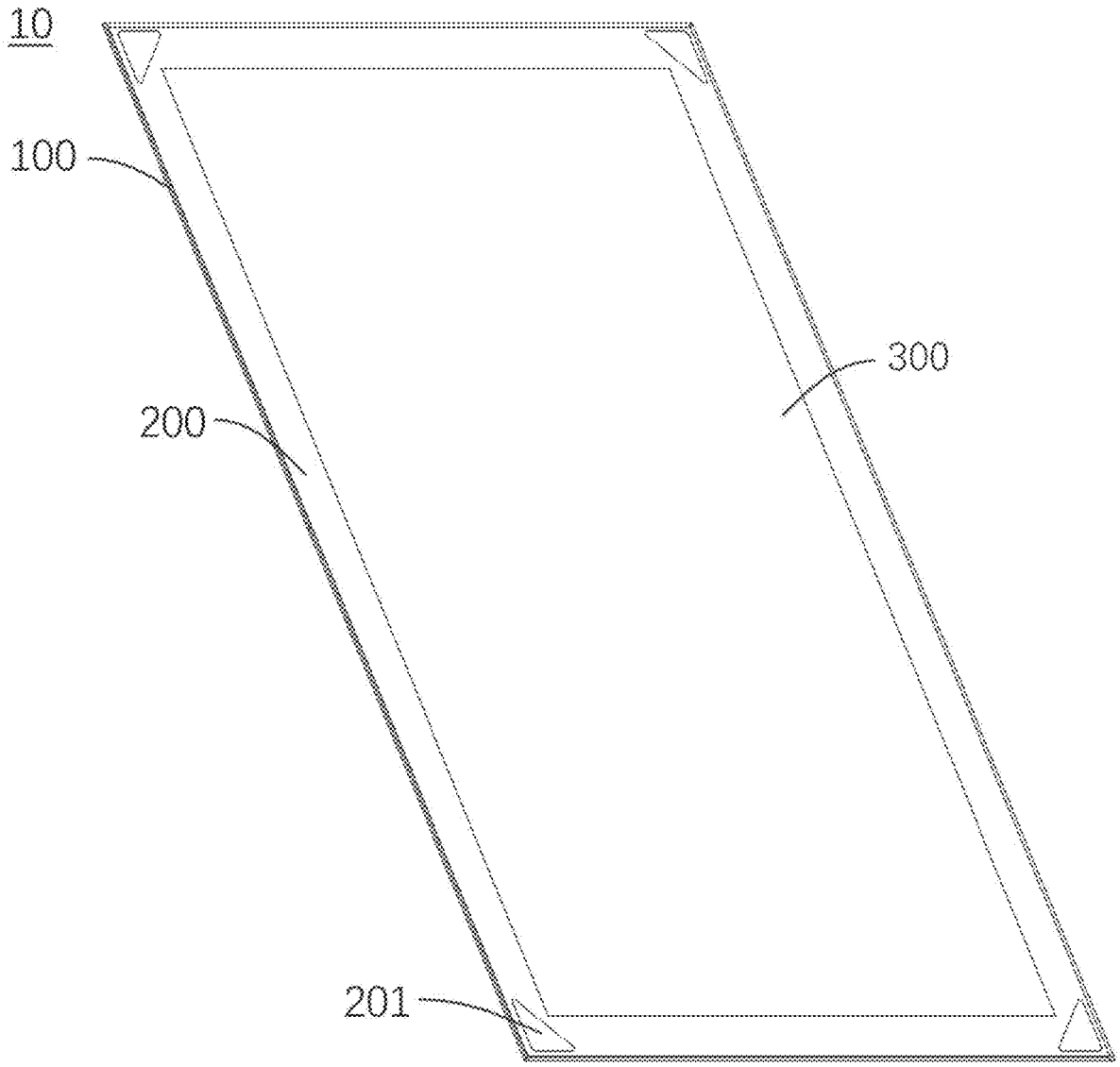
FIG. 11 is a schematic structural view of a detachable carpet in Embodiment 9 of the present invention.
Figure 12:
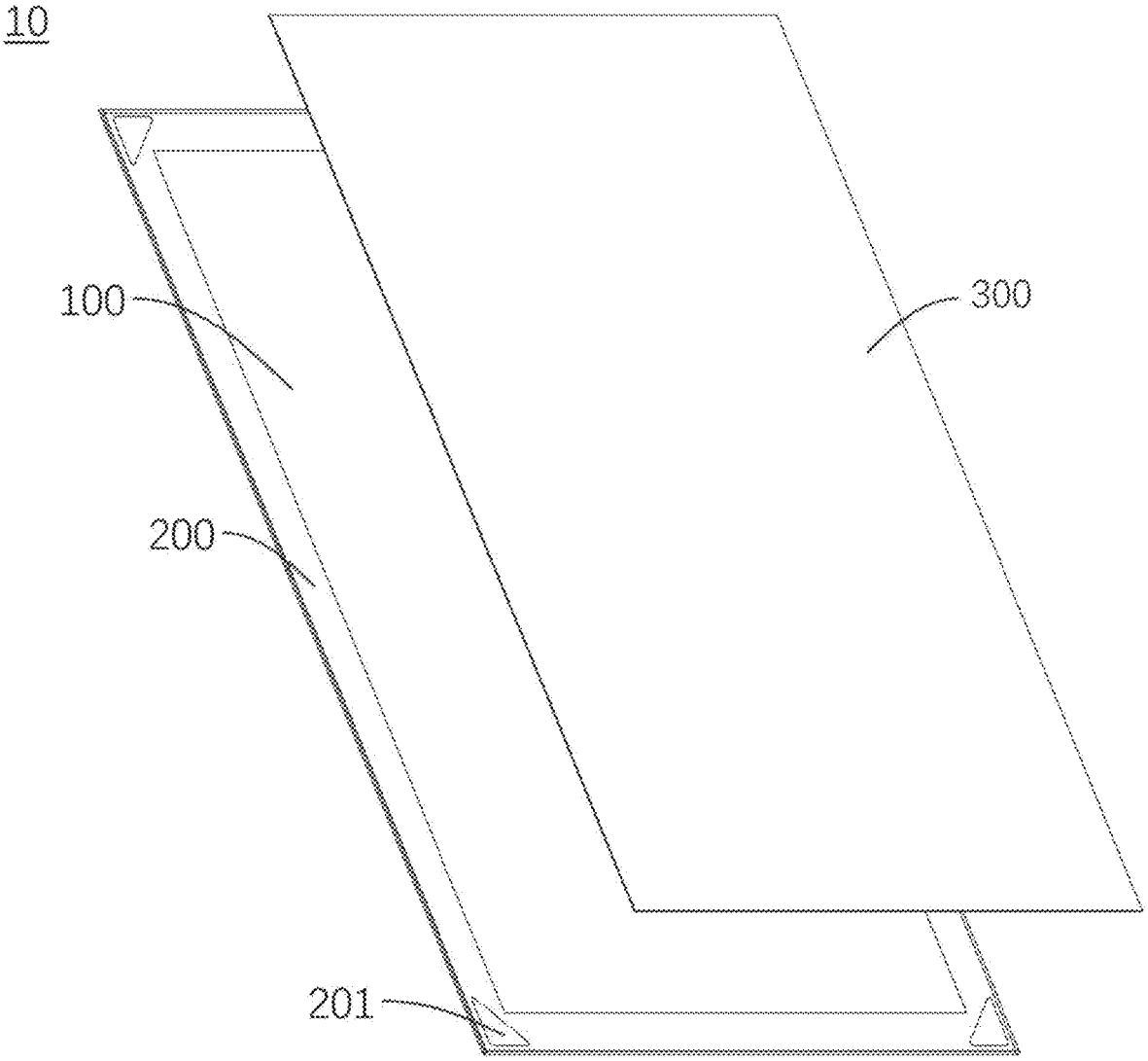
FIG. 12 is an exploded structural view of the detachable carpet in Embodiment 9 of the present invention.

In Embodiment 9, as shown in FIGS. 11 and 12, carpet sticker 201 is set on one side of the edge strip 200 facing the ground to increase the friction between the detachable carpet 10 and the ground, preventing slipping, enhancing the firmness of the connection between the detachable carpet 10 and the ground, while improving the softness and sound insulation of the detachable carpet 10, enhancing comfort.

In some embodiments, the carpet sticker 201 and the edge strip 200 can be connected via Velcro, magnet, button, gluing, or nail structures.

In some embodiments, the edge strip 200 is connected to the side of the mat 300 facing the carpet cover 100. The edge strip 200 and the mat 300 are separate structures.

In some embodiments, the edge strip 200 and the mat 300 are connected via fixed or detachable connections.

C. Mat 300

In Embodiment 10, a pre-fixed structure can be set between mat 300 and carpet cover 100 during installation to prevent misalignment. The mat 300 is detachably connected to the center or corners of the carpet cover 100 via the pre-fixed structure to pre-fix the mat 300. For example, center pre-fixing refers to setting pre-fixed structures at the center of mat 300 and carpet cover 100 to ensure alignment during installation. Corner pre-fixing refers to setting pre-fixed structures at the four corners of mat 300 and the carpet cover 100 to prevent corner lifting or shifting.

Figure 13:
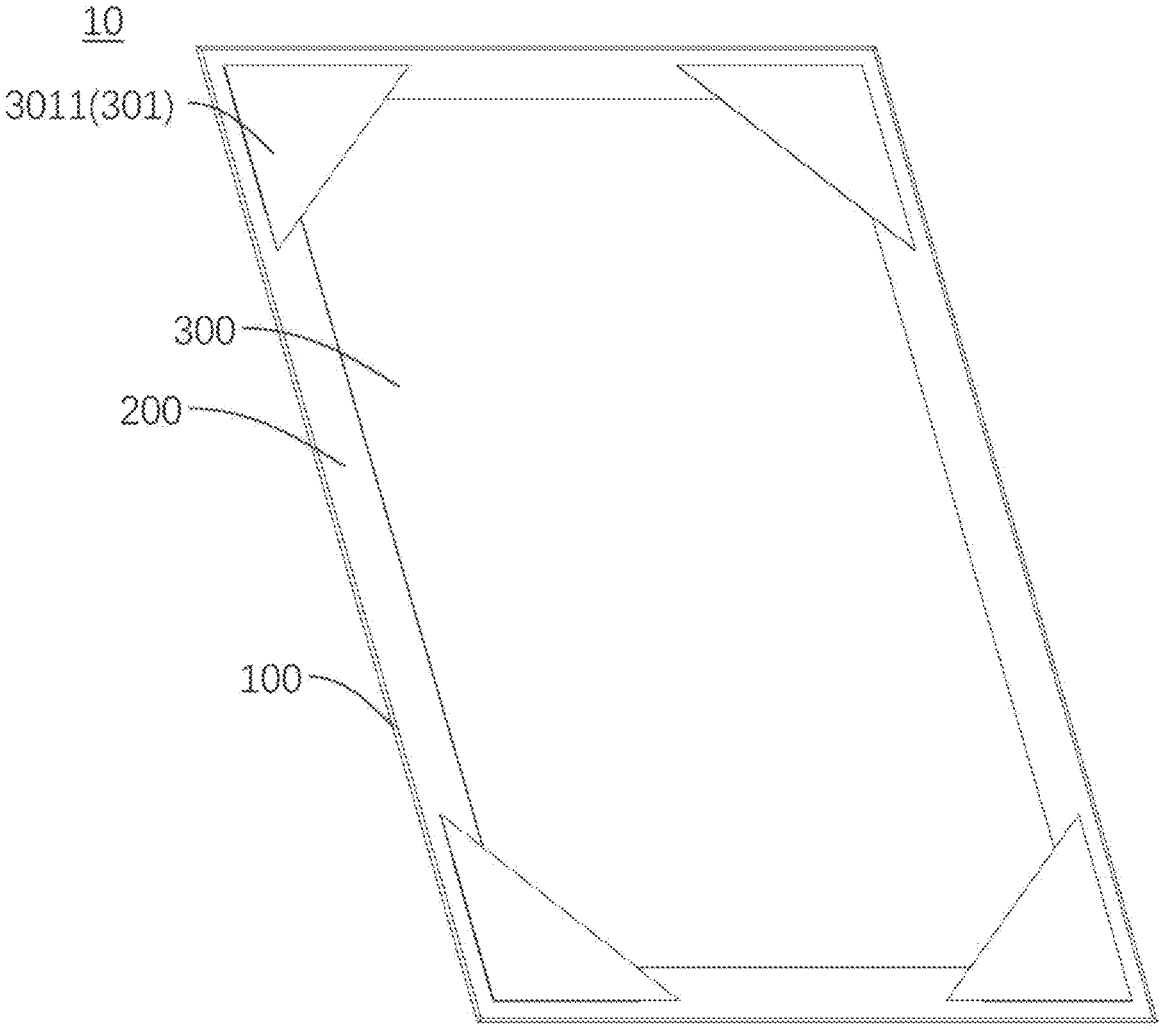
FIG. 13 is a schematic structural view of a detachable carpet in Embodiment 10 of the present invention.

In Embodiment 10, as shown in FIG. 13, the pre-fixed structure is a slot structure 301. The mat 300 is detachably connected to the carpet cover 100 via the slot structure 301. The slot structure 301 is set at the four corners of the carpet cover 100, and the four corners of the mat 300 can be selectively inserted into the slot structure 301 at the four corners of the carpet cover 100. By inserting the four corners of mat 300 into slot structure 301, mat 300 and the carpet cover 100 are pre-fixed. Then, the four sides of mat 300 are inserted into the four edge strip 200, respectively, to fix the mat 300.

Figure 14:
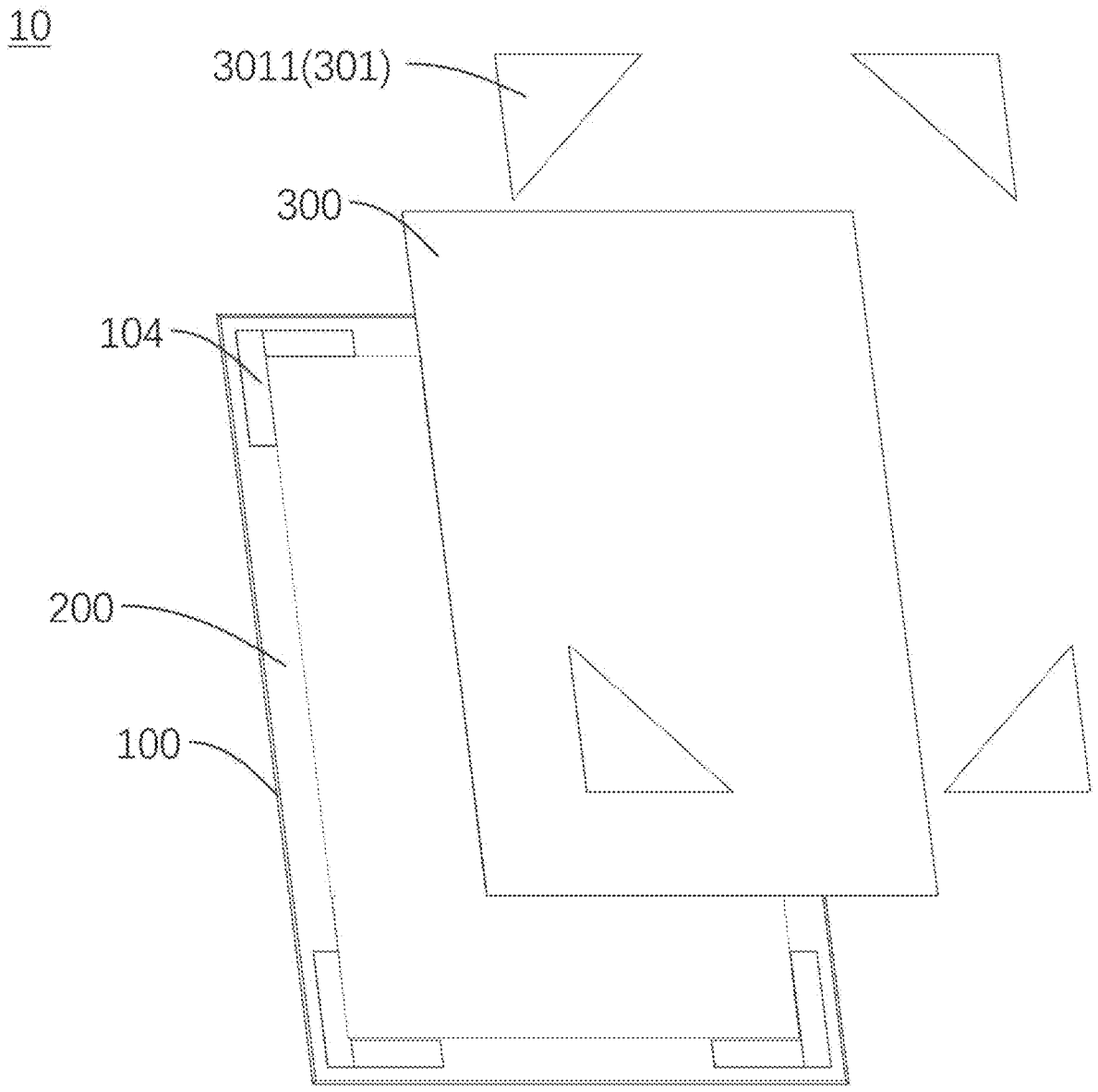
FIG. 14 is an exploded structural view of a detachable carpet in Embodiment 11 of the present invention.

In Embodiment 11, as shown in FIG. 14, the side of the carpet cover 100 facing slot structure 301 is detachably connected to the side of slot structure 301 facing the carpet cover 100 via Velcro structure 104.

During use, the carpet cover 100 and the mat 300 are tightly combined, providing dust removal, anti-slip, and shock absorption functions. When cleaning or replacement is needed, remove the four corners of mat 300 from slot structure 301 to clean or replace the mat 300 separately, without replacing the entire carpet 10, saving cost and time and meeting different needs (such as replacing carpet covers 100 with different colors or functions).

In some embodiments, the edges of the carpet cover 100 facing the mat 300 and the edges of the slot structure 301 facing the carpet cover 100 are connected via magnet or button structures.

In some embodiments, the side of the mat 300 facing the ground and the corresponding position on the ground are provided with Velcro's hook surface and loop surface, respectively. Pressing them together achieves a connection, making them simple to operate, easy to disassemble and replace, and suitable for occasions requiring frequent adjustments.

In some embodiments, the adhesive is evenly applied to the side of the mat 300 facing the ground and the corresponding position on the ground. After that, press firmly to ensure the detachable carpet 10 is tightly bonded to the ground, suitable for hard floors (such as wood or tile), providing a firm fixing effect and preventing slipping.

In some embodiments, the side of the mat 300 facing the ground and the corresponding position on the ground are connected via tape.

In some embodiments, the side of the mat 300 facing the ground is connected via carpet nails or carpet strips with the corresponding position on the ground. Carpet nails are suitable for thick or large detachable carpets 10, while carpet strips provide firm fixing for long-term use.

In some embodiments, an anti-slip mat is laid under the side of the mat 300 facing the ground to ensure the mat tightly fits the ground, increasing the friction between the detachable carpet 10 and the ground, preventing slipping, especially suitable for smooth floors.

In some embodiments, to fix the detachable carpet 10, heavy objects (such as furniture or weight blocks) are placed at the four corners of the detachable carpet 10 to help fix it, suitable for temporary laying or small-sized detachable carpets 10, simple to operate without additional tools.

In some embodiments, to fix the detachable carpet 10, detachable slot structures are designed at the four corners of the surface of the detachable carpet 10 or the side facing the ground. Heavy objects are placed inside the slot structures to enhance the fixing effect, facilitating disassembly and adjustment and providing stable fixing effects suitable for occasions requiring flexible adjustments.

The embodiments described above are merely examples of the present disclosure, and should not be used to limit the scope of the present disclosure, which may have various modifications and variations made by specialists in the field. Any modification, equivalent replacement or improvement made within the spirits and principles of the present disclosure shall be included in the scope of protection of the present disclosure.

What is claimed is:

1. A detachable carpet, comprising:

a carpet cover configured as a surface layer with multiple edges;

multiple edge strips coupled to a bottom-side of the carpet cover, wherein the multiple edge strips and the carpet cover are separate structures; and a mat configured as a bottom layer with multiple edges;

wherein the mat is detachably couple to the carpet cover via friction between the multiple edge strips and the mat;

wherein the multiple edge strips wrap around the edges of the mat when the mat is detachably coupled to the carpet cover to prevent the carpet cover from curling up and shifting;

wherein the multiple edge strips are coupled at the outer perimeter of the bottom-side of the edges of the carpet cover; and wherein each edge strip runs the length of the outer perimeter of each edge of the carpet cover.

2. The detachable carpet of claim 1, wherein the multiple edge strips are fixedly coupled to the carpet cover.

3. The detachable carpet of claim 2, wherein the multiple edge strips are fixedly coupled to the carpet cover by a stitch-locking structure with stitch threads, wherein the stitch threads pass through the edges of the multiple edge strips and the carpet cover.

4. The detachable carpet of claim 2, wherein the multiple edge strips are fixedly coupled to the carpet cover by a gluing structure comprising a hot melt adhesive or double-sided tape applied to the contact surfaces of the multiple edge strips and the carpet cover.

5. The detachable carpet of claim 1, wherein the multiple edge strips are detachably coupled to the carpet cover.

6. The detachable carpet of claim 5, wherein the edge strips are detachably coupled to the carpet cover through a hook and loop structure.

7. The detachable carpet of claim 6, wherein the hook and loop structure comprises a hook surface and a loop surface; and wherein the hook surface is fixed to the side of the multiple edge strips facing the carpet cover and the loop surface is fixed to the corresponding side of the carpet cover facing the multiple edge strips.

8. The detachable carpet of claim 5, wherein the multiple edge strips are detachably coupled to the carpet cover through a button structure comprising a button and a buttonhole; and wherein the button is fixed to the side of the multiple edge strips facing the carpet cover, and the buttonhole is fixed to the corresponding side of the carpet cover facing the multiple edge strips.

9. The detachable carpet of claim 5, wherein the multiple edge strips are detachably coupled to the carpet cover through a zipper structure comprising zipper teeth and a zipper head, wherein the zipper teeth are fixed to the sides of the multiple edge strips and carpet cover facing each other.

10. The detachable carpet of claim 5, wherein the multiple edge strips are detachably coupled to the carpet cover through a magnet structure comprising a first magnet portion and a second magnet portion; wherein the first magnet portion is fixed to the side of the multiple edge strips facing the carpet cover and the second magnet portion is fixed to the corresponding side of the carpet cover facing the multiple edge strips.

11. The detachable carpet of claim 1, wherein the edge strips and the mat are detachably coupled through a friction structure comprising a surface with high roughness or a textured pattern formed through surface treatment.

12. The detachable carpet of claim 11, wherein the surface treatment methods include at least one of flame treatment, silicone dot molding, or hot-press lamination.

13. The detachable carpet of claim 1, wherein the number of edge strips corresponds to the number of edges of the carpet cover.

14. The detachable carpet of claim 1, wherein the mat and the carpet cover are coupled via fixed structures located at pre-determined points along the edges of the carpet cover thereby securing the mat to the carpet cover at the pre-determined points.

15. The detachable carpet of claim 14, wherein the pre-determined points are located at each edge of the carpet cover; wherein the fixed structures are slot structures and the mat is inserted into the slot structures to affix the mat to the carpet cover at each edge.

* * * * *